US009065202B2

(12) United States Patent
Wu et al.

(10) Patent No.: US 9,065,202 B2
(45) Date of Patent: Jun. 23, 2015

(54) CONNECTOR ASSEMBLY

(71) Applicant: HON HAI PRECISION INDUSTRY CO., LTD., New Taipei (TW)

(72) Inventors: Yi-Fang Wu, New Taipei (TW); Foo See Woei, Guangdong (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/137,198

(22) Filed: Dec. 20, 2013

(65) Prior Publication Data

US 2014/0342595 A1 Nov. 20, 2014

(30) Foreign Application Priority Data

May 16, 2013 (CN) ..... 2013 1 01807051

(51) Int. Cl.
*H01R 13/58* (2006.01)

(52) U.S. Cl.
CPC ..... *H01R 13/5833* (2013.01)

(58) Field of Classification Search
CPC ..... H01R 13/5833; H01R 13/58; H01R 13/56
USPC ..... 39/456
See application file for complete search history.

(56) References Cited

U.S. PATENT DOCUMENTS

| | | | | |
|---|---|---|---|---|
| 5,509,812 | A * | 4/1996 | Comerci et al. | 439/76.1 |
| 6,513,961 | B2 * | 2/2003 | Nagai et al. | 362/549 |
| 6,621,023 | B2 * | 9/2003 | Nagai | 200/292 |
| 6,767,241 | B1 * | 7/2004 | Abel et al. | 439/417 |
| 2008/0160824 | A1 * | 7/2008 | Liu et al. | 439/456 |
| 2010/0330837 | A1 * | 12/2010 | Wegener | 439/456 |

* cited by examiner

*Primary Examiner* — Jean F Duverne
(74) *Attorney, Agent, or Firm* — Novak Druce Connolly Bove + Quigg LLP

(57) ABSTRACT

A connector assembly includes a connecting body and a protecting cover mounted to the connecting body. The connecting body includes a first limiting portion and a second limiting portion. The connecting body is configured to accommodate multiple connecting lines. A first limiting hole and a first limiting slot are defined in the first limiting portion. A second limiting hole and a second limiting slot are defined in the second limiting portion. The protecting cover includes two flanges and two limiting brackets. An accommodating space is defined in the protecting cover. The flanges resist against the first limiting portion and the second limiting portion. The limiting brackets are locked in the first limiting hole and the second limiting hole. The flanges are received in the first limiting slot and the second limiting slot. The number of connecting lines extend to an outside of the protecting cover from the accommodating space.

18 Claims, 4 Drawing Sheets

CONNECTOR ASSEMBLY

BACKGROUND

1. Technical Field

The present disclosure relates to a connector assembly with protecting cover.

2. Description of Related Art

Connectors are widely used on printed circuit boards (PCBs) and cable assembly. A conventional connector includes an inserting portion and multiple connecting lines extending from the inserting portion. The multiple connecting lines usually are exposed, which may be dangerous.

Therefore, there is a need for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
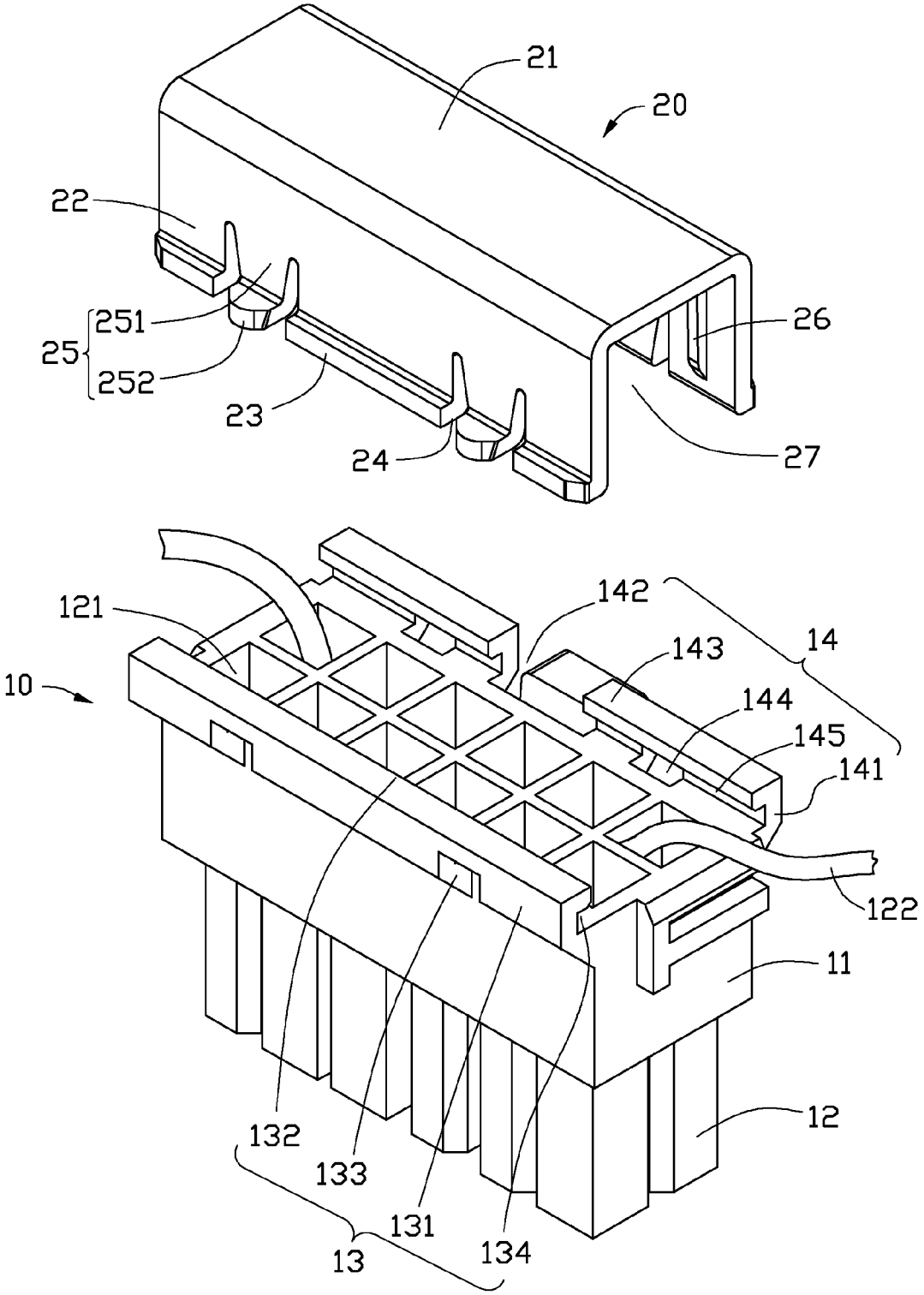
FIG. 1 is an isometric, exploded view of an embodiment of a connector assembly, viewed from one aspect.
Figure 2:
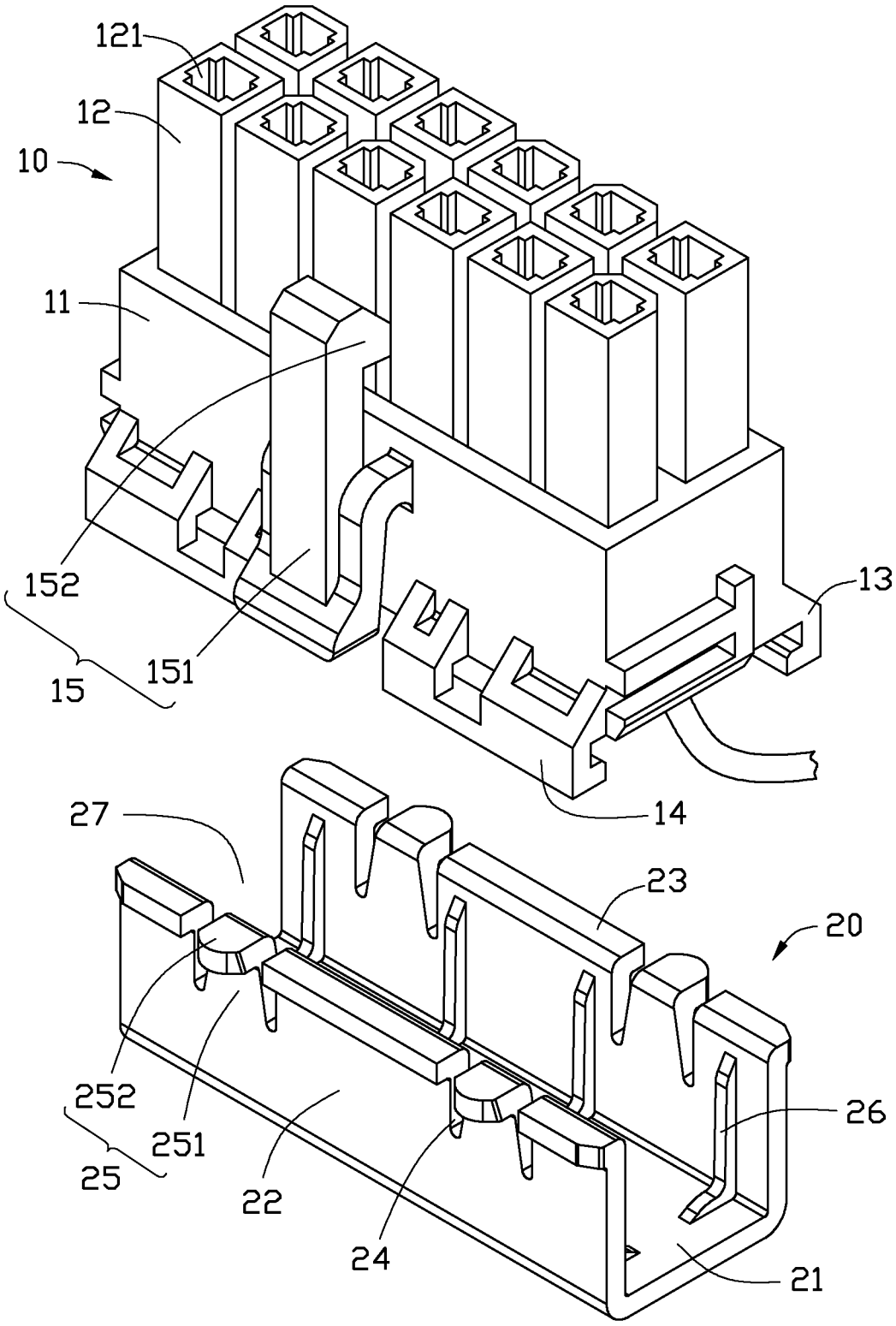
FIG. 2 is an isometric, exploded view of an embodiment of a connector assembly, viewed from another aspect.

FIGS. 1 and 2 show a connector assembly in accordance with one embodiment. The connector assembly includes a connecting body 10 and a protecting cover 20 mounted to the connecting body 10.

The connecting body 10 includes a mounting portion 11 and multiple inserting portions 12 substantially perpendicularly extending from the mounting portion 11. Each of the multiple inserting portions 12 defines a substantially rectangular accommodating hole 121. The accommodating holes 121 extend through the mounting portion 11. Multiple connecting lines 122 pass through the accommodating holes 121. A first limiting portion 13 and a second limiting portion 14 extend from two opposite sides of the mounting portion 11. The first limiting portion 13 includes a first connecting wall 131 substantially perpendicularly extending from a first side edge of the mounting portion 11. A first top wall 132 substantially horizontally extends from a top edge of the first connecting wall 131. Two first limiting holes 133 are defined between the mounting portion 11 and the first connecting wall 131. The mounting portion 11, the first connecting wall 131 and the first top wall 132 cooperatively define a first limiting slot 134.

The second limiting portion 14 includes a second connecting wall 141 substantially perpendicularly extending from a second side edge of the mounting portion 11. A cutout 142 is defined in the second connecting wall 141. A second top wall 143 substantially horizontally extends from a top edge of the second connecting wall 141. Two second limiting holes 144 are defined between the mounting portion 11 and the second connecting wall 141. The two second limiting holes 144 are positioned on two sides of the cutout 142. The mounting portion 11, the second connecting wall 141 and the second top wall 143 cooperatively define a second limiting slot 145. A hook 15 is formed on the mounting portion 11 adjacent to the cutout 142. The hook 15 includes a first connecting portion 151 connected to the mounting portion 11. A first locking portion 152 extends from a distal end of the first connecting portion 151.

In one embodiment, the first connecting portion 151 is an elastic bracket. The hook 15 is adapted to lock on a female connector (not shown). The connecting body 10 is electrically connected to the female connector by the multiple connecting lines 122.

The protecting cover 20 includes a third connecting wall 21 and two sidewalls 22 substantially perpendicularly extending from two opposite sides of the third connecting wall 21. A flange 23 substantially perpendicularly extends from a bottom edge of each of the two sidewalls 22. Two openings 24 are defined between each of the two sidewalls 22 and the corresponding flange 23. A limiting bracket 25 is formed in each of the openings 24. The limiting bracket 25 includes a second connecting portion 251 extending from the corresponding opening 24. A second locking portion 252 substantially horizontally extends from a distal end of the second connecting portion 251. Multiple strengthening ribs 26 protrude between the third connecting wall 21 and the corresponding sidewall 22. The third connecting wall 21 and the two sidewalls 22 cooperatively define an accommodating space 27. The multiple connecting lines 122 extend to an outside of the protecting cover 20 from two opposite sides of the accommodating space 27.

In one embodiment, the two sidewalls 22 are elastic brackets. A width of each of the flanges 23 is substantially equal to a width of the first limiting slot 134 and a width of the second limiting slot 145. A length of each of the two first limiting holes 133 is substantially equal to a length of each of the two second limiting holes 144 and a length of each of the second locking portions 252. The width of the first limiting slot 134 and the width of the second limiting slot 145 is less than a width of each of the second locking portions 252.

Figure 3:
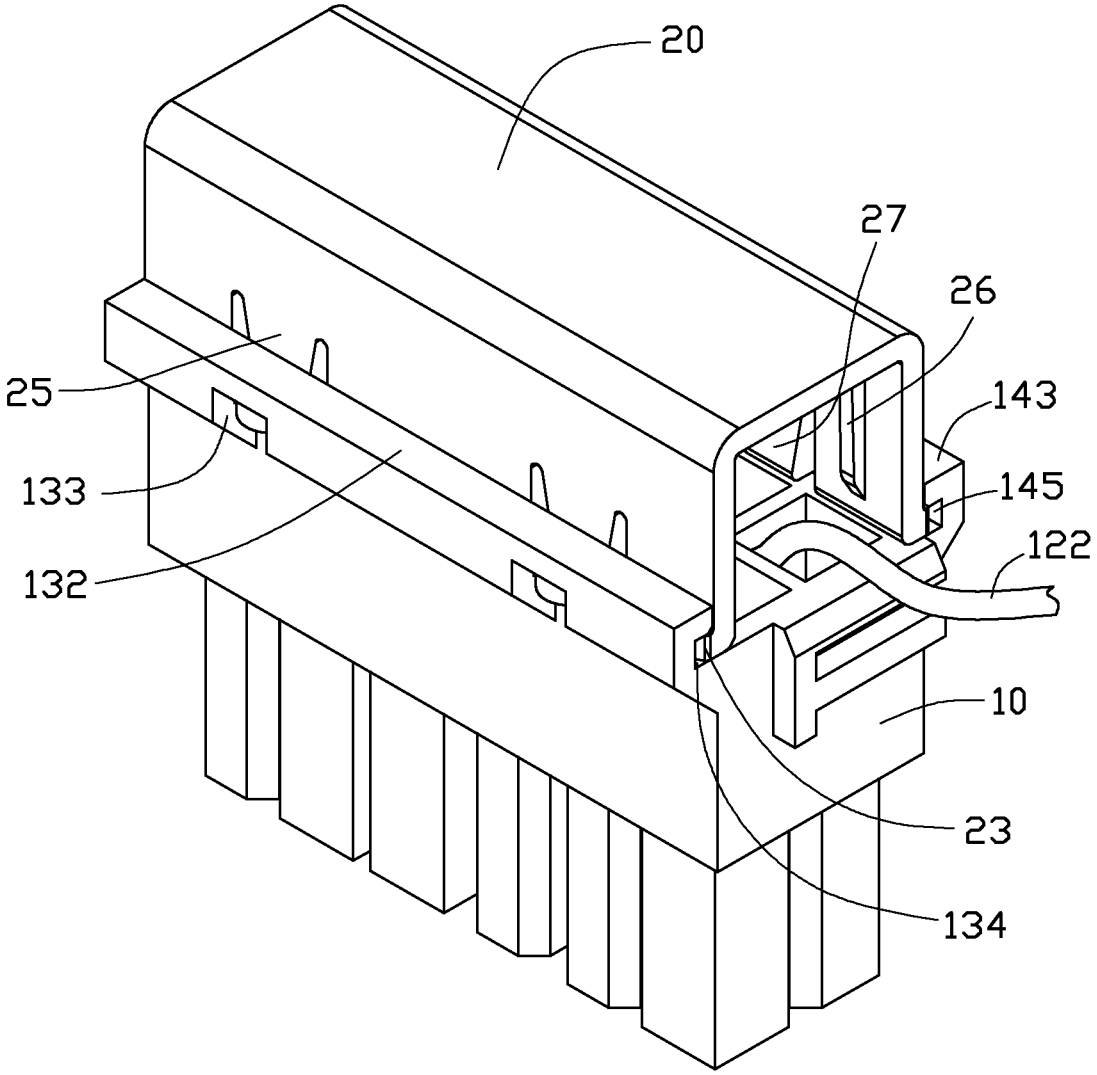
FIG. 3 is an assembled view of the connector assembly of FIG. 1.
Figure 4:
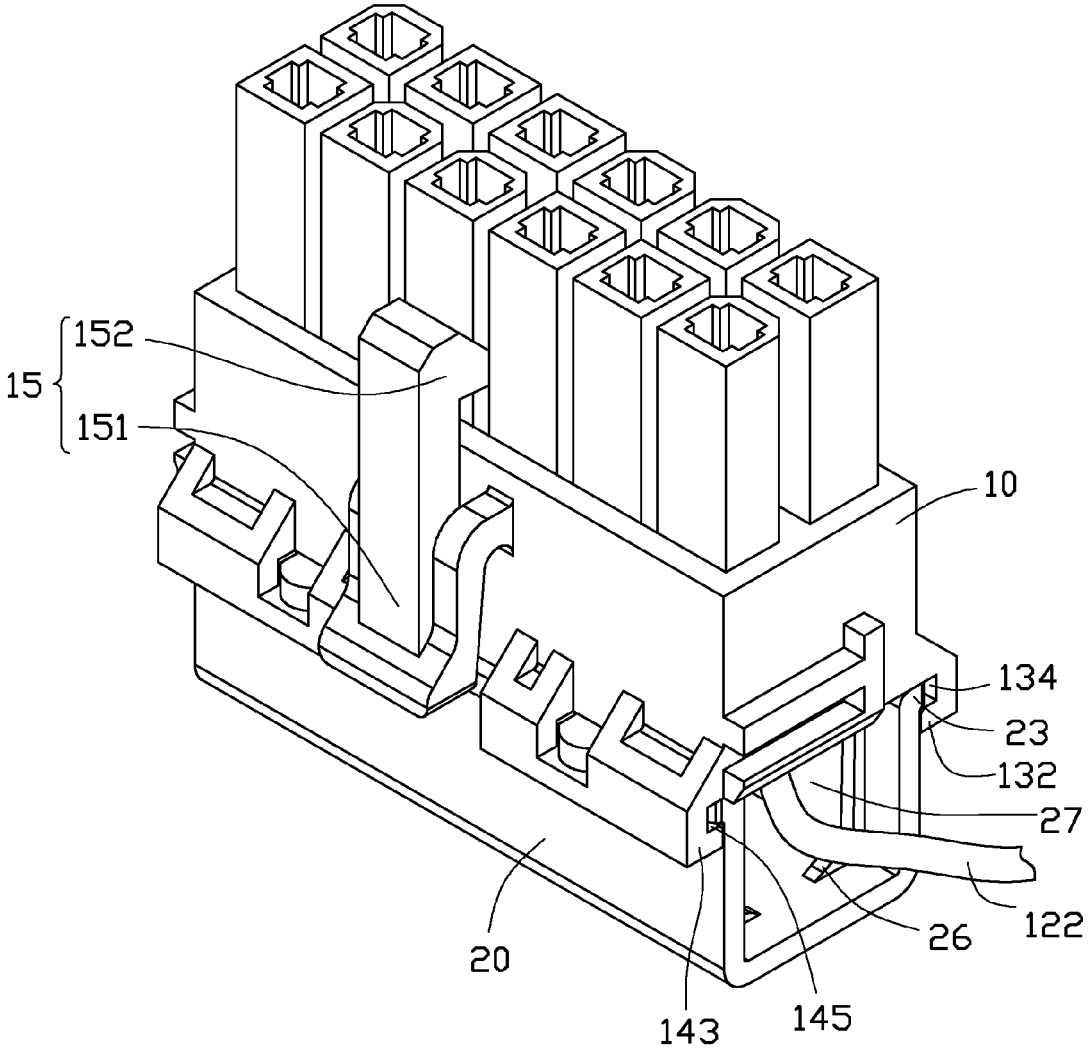
FIG. 4 is an assembled view of the connector assembly of FIG. 2.

FIGS. 3 and 4 show that in use, the two sidewalls 22 of the protecting cover 20 are moved toward the first limiting portion 13 and the second limiting portion 14 of the connecting body 10. The flanges 23 and the limiting brackets 25 resist against the first top wall 132 and the second top wall 143. The first top wall 132 and the second top wall 143 resist against the two sidewalls 22 by the flanges 23 and the second locking portions 252. The two sidewalls 22 and the second connecting portions 251 are elastically deformed slightly. The protecting cover 20 continually moves toward the connecting body 10 until the second locking portions 252 are locked in the two first limiting holes 133 and the two second limiting holes 144. The two sidewalls 22 and the second connecting portions 251 elastically return. The flanges 23 are received in the first limiting slot 134 and the second limiting slot 145. The protecting cover 20 is mounted to the connecting body 10.

The first connecting wall 131 and the first connecting portion 151 are pressed to rise up the first locking portion 152 slightly. The multiple inserting portions 12 are moved toward the female connector until the multiple connecting lines 122 are electrically connected to the female connector. The first connecting portion 151 is released. The first locking portion 152 elastically returns and locks on the female connector.

In one embodiment, the multiple strengthening ribs 26 are adapted to strengthen the two sidewalls 22. The multiple strengthening ribs 26 prevent the two sidewalls 22 being elastically deformed unduly and cannot elastically return. The protecting cover 20 shields and protects the multiple connecting lines 122 in the connecting body 10. Therefore danger caused by the wearing of the multiple connecting lines 122 is avoided. The protecting cover 20 is not limited to be mounted to the connecting body 10 by the above process. In another embodiment, the flanges 23 of the protecting cover 20 slide in the first limiting slot 134 and the second limiting slot 145 from one side of the connecting body 10. The first connecting wall 131 and the second connecting wall 141 resists against the two sidewalls 22 by the corresponding second locking portions 252. The second connecting portions 251 are elastically deformed slightly. The protecting cover 20 continually slides in the connecting body 10 until the second locking portions 252 are locked in the two first limiting holes 133 and the two second limiting holes 144. The second connecting portions 251 elastically return. The flanges 23 are received in the first limiting slot 134 and the second limiting slot 145. The protecting cover 20 is mounted to the connecting body 10.

Even though numerous characteristics and advantages of the present disclosure have been set forth in the foregoing description, together with details of the structure and function of the disclosure, the disclosure is illustrative only, and changes may be made in detail, especially in the matters of shape, size, and the arrangement of parts within the principles of the disclosure to the full extent indicated by the broad general meaning of the terms in which the appended claims are expressed.

What is claimed is:

1. A connector assembly, comprising:

a connecting body comprising a first limiting portion and a second limiting portion; wherein the connecting body is configured to accommodate multiple connecting lines; a first limiting hole and a first limiting slot are defined in the first limiting portion; a second limiting hole and a second limiting slot are defined in the second limiting portion; and a protecting cover mounted to the connecting body, the protecting cover comprising two flanges and two limiting brackets, an accommodating space defined in the protecting cover, each of the two limiting brackets comprising a second connecting portion and a second locking portion, wherein the second connecting portions are being deformed as the protecting cover is configured to move toward the connecting body until the second locking portions are locked in the first and the second limiting holes and the protecting cover covers the connection body; the second connecting portions elastically returns causing the two flanges being received in the first and the second limiting slots and the protecting cover covers the connecting body; and when the protecting cover covers the connecting body, two sides of the accommodating space can be accessed from out of the connector assembly.

2. The connector assembly of claim 1, wherein the connecting body comprises a mounting portion; the first limiting portion comprises a first connecting wall substantially perpendicularly extending from the mounting portion; a first top wall substantially horizontally extends from the first connecting wall; the first limiting hole is defined between the mounting portion and the first connecting wall; and the mounting portion, the first connecting wall and the first top wall cooperatively define the first limiting slot.

3. The connector assembly of claim 2, further comprising multiple inserting portions substantially perpendicularly extending from the mounting portion, wherein each of the multiple inserting portions defines an accommodating hole; the accommodating hole extends through the mounting portion; the multiple connecting lines pass through the accommodating holes; and the connecting body is electrically connected to a female connector by the multiple connecting lines.

4. The connector assembly of claim 2, wherein the second limiting portion comprises a second connecting wall substantially perpendicularly extending from the mounting portion; a second top wall substantially horizontally extends from the second connecting wall; the second limiting hole is defined between the mounting portion and the second connecting wall; and the mounting portion, the second connecting wall and the second top wall cooperatively define the second limiting slot.

5. The connector assembly of claim 2, wherein the mounting portion further comprises a hook; the hook comprises a first connecting portion connected to the mounting portion; a first locking portion extends from the first connecting portion; and the first locking portion locks on the female connector.

6. The connector assembly of claim 5, wherein the protecting cover comprises a third connecting wall and two sidewalls substantially perpendicularly extending from the third connecting wall; the two flanges and the two limiting brackets are formed on a respective sidewall of the two sidewalls; an opening is defined in each of the two sidewalls; the second connecting portion is formed in the opening; the second locking portion substantially horizontally extends from the second connecting portion; and the third connecting wall and the two sidewalls cooperatively define the accommodating space.

7. The connector assembly of claim 6, further comprising multiple strengthen ribs protruding between the third connecting wall and a respective side wall of the two sidewalls; and the strengthen ribs are configured to strengthen the two sidewalls.

8. The connector assembly of claim 6, wherein the first connecting portion and the two sidewalls are elastic brackets.

9. The connector assembly of claim 1, wherein a width of each of the two flanges is substantially equal to a width of the first limiting slot and a width of the second limiting slot; a length of the first limiting hole is substantially equal to a length of the second limiting hole and a length of each of the second locking portions; and the width of the first limiting slot and the width of the second limiting slot is less than a width of each of the second locking portions.

10. A connector assembly, comprising:

a connecting body comprising a mounting portion, a first limiting portion and a second limiting portion extending from the mounting portion; wherein multiple inserting portions substantially perpendicularly extending from the mounting portion; each of the multiple inserting portions defines an accommodating hole; the accommodating hole extends through the mounting portion; the accommodating holes are configured to accommodate multiple connecting lines; a first limiting hole and a first limiting slot are defined in the first limiting portion; a second limiting hole and a second limiting slot are defined in the second limiting portion; and a protecting cover mounted to the connecting body; the protecting cover comprising two flanges and two limiting brackets, an accommodating space defined in the protecting cover, each of the two limiting brackets comprising a second connecting portion and a second locking portion, wherein the second connecting portions are being deformed as the protecting cover is configured to move toward the connecting body until the second locking portions are locked in the first and the second limiting holes and the protecting cover covers the connection body; the second connecting portions elastically returns causing the two flanges being received in the first and the second limiting slots and the protecting cover covers the connecting body; and when the protecting cover covers the connecting body, two sides of the accommodating space can be accessed from out of the connector assembly.

11. The connector assembly of claim 10, wherein the first limiting portion comprises a first connecting wall substantially perpendicularly extending from the mounting portion; a first top wall substantially horizontally extends from the first connecting wall; the first limiting hole is defined between the mounting portion and the first connecting wall; and the mounting portion, the first connecting wall and the first top wall cooperatively define the first limiting slot.

12. The connector assembly of claim 11, wherein the connecting body is electrically connected to a female connector by the multiple connecting lines.

13. The connector assembly of claim 11, wherein the second limiting portion comprises a second connecting wall substantially perpendicularly extending from the mounting portion; a second top wall substantially horizontally extends from the second connecting wall; the second limiting hole is defined between the mounting portion and the second connecting wall; and the mounting portion, the second connecting wall and the second top wall cooperatively define the second limiting slot.

14. The connector assembly of claim 11, wherein the mounting portion further comprises a hook; the hook comprises a first connecting portion connected to the mounting portion; a first locking portion extends from the first connecting portion; and the first locking portion locks on the female connector.

15. The connector assembly of claim 14, wherein the protecting cover comprises a third connecting wall and two sidewalls substantially perpendicularly extending from the third connecting wall; the two flanges and the two limiting brackets are formed on a respective sidewall of the two sidewalls; an opening is defined in each of the two sidewalls; the second connecting portion is formed in the opening; the second locking portion substantially horizontally extends from the second connecting portion; and the third connecting wall and the two sidewalls cooperatively define the accommodating space.

16. The connector assembly of claim 15, further comprising multiple strengthen ribs protruding between the third connecting wall and a respective side wall of the two sidewalls; and the strengthen ribs are configured to strengthen the two sidewalls.

17. The connector assembly of claim 15, wherein the first connecting portion and the two sidewalls are elastic brackets.

18. The connector assembly of claim 10, wherein a width of each of the two flanges is substantially equal to a width of the first limiting slot and a width of the second limiting slot; a length of the first limiting hole is substantially equal to a length of the second limiting hole and a length of each of the second locking portions; and the width of the first limiting slot and the width of the second limiting slot is less than a width of each of the second locking portions.

* * * * *